United States Patent [19]

Eriksson et al.

[11] Patent Number: 5,042,363

[45] Date of Patent: Aug. 27, 1991

[54] DEVICE FOR REMOTE CONTROL, WITH POSSIBILITY FOR DIRECT CONTROL, HYDRAULIC DIRECTIONAL VALVES

[75] Inventors: Lars P. Eriksson, Dalsjöfors; Bengt-Göran Persson, Sandared, both of Sweden

[73] Assignee: Atlas Copco Aktiebolag AB, Sweden

[21] Appl. No.: 429,941

[22] Filed: Nov. 1, 1989

[30] Foreign Application Priority Data

Nov. 3, 1988 [SE] Sweden ..... 8803998

[51] Int. Cl.[5] ..... F15B 13/10

[52] U.S. Cl. ..... 91/391 A; 92/129; 92/DIG. 4; 137/625.66; 251/14; 251/289

[58] Field of Search ..... 91/391 R, 391 A; 92/129, DIG. 4; 137/625.66; 251/14, 289

[56] References Cited

U.S. PATENT DOCUMENTS

| | | | |
|---|---|---|---|
| 2,229,247 | 1/1941 | Kamenarovic | 92/129 |
| 2,649,842 | 8/1953 | Caldwell et al. | 92/DIG. 4 |
| 3,424,062 | 11/1966 | Gummer et al. | 92/129 |
| 3,502,003 | 3/1970 | Dobrikin et al. | 92/129 |
| 4,069,836 | 1/1978 | Sowinski | 251/289 |
| 4,089,392 | 5/1978 | Ostrowski | 92/129 |
| 4,469,119 | 9/1984 | Snyder et al. | 137/625.66 |

FOREIGN PATENT DOCUMENTS

| | | | |
|---|---|---|---|
| A2-0134744 | 7/1984 | European Pat. Off. . | |
| DEC2-3518750 | 4/1988 | Fed. Rep. of Germany . | |
| B-428590 | 7/1983 | Sweden . | |
| 726553 | 3/1955 | United Kingdom | 92/129 |

*Primary Examiner*—Edward K. Look
*Assistant Examiner*—F. Daniel Lopez
*Attorney, Agent, or Firm*—Nixon & Vanderhye

[57] ABSTRACT

The invention aims at bringing about a device for remote controlling of, for example, directional valves, which likewise allows a manual direct controlling, using a hand lever, for example. The control device includes a hydraulic cylinder (37) with ports (31,32) for feeding and evacuating, respectively, of hydraulic fluid, a piston (14) arranged in the cylinder (37), as well as a piston rod (13), for accomplishing the controlling function. The piston rod (13) is arranged to be slideably supported in the piston (14), allowing a limited movement of the piston rod (13) relative to the piston (14) independent of the pressure and load conditions in the cylinder (37), the movement possibility of the piston rod (13) being limited in at least one direction by a stop (17) arranged on the piston rod.

3 Claims, 3 Drawing Sheets

DEVICE FOR REMOTE CONTROL, WITH POSSIBILITY FOR DIRECT CONTROL, HYDRAULIC DIRECTIONAL VALVES

TECHNICAL AREA OF THE INVENTION

The invention refers to a device for remote control with possibility for direct control of, for example, hydraulic directional valves. The invention includes a hydraulic cylinder with ports for feeding and evacuating of hydraulic fluid, a piston arranged in the cylinder and a piston rod, by means of which a control function can be achieved.

BACKGROUND OF THE INVENTION

Maneuvering of hydraulic directional valves can be done by direct controlling with, for example, hand levers in the immediate vicinity of the valve, or with remote controlling at greater or lesser distances from the directional valve. Using the latter alternative may require the use of mechanical control devices such as articulated rods, Bowden wires, etc. or hydraulic and electro-hydraulic controls. These can of course be combined in varying ways. One example of such a combination form of controlling is the maneuvering unit for a truck crane which is normally located on the truck frame behind the cab (not shown). Here the object is that the operator should be able partly to directly maneuver the directional valve by means of a hand lever in the immediate vicinity of the crane; partly to maneuver it from the opposite side of the vehicle by using a hand lever, which here would be done via an articulated rod; partly from a portable maneuvering station via, for example, electrical cables connected to a double-acting, electro-hydraulic (+EHC) control device.

The EHC control device is usually mechanically connected with the articulated rod with aid of clamps coupled to the piston rod of the control device. The latter has a double-acting operation and a proportional piston rod movement which is a function of the set controlling pressure. In order for it to lie within an appropriate area, for example between 5 and 15 bars, it is necessary to have a strong spring assembly in the control device. This spring assembly handles centering of the control device piston. In other words, the spring assembly must be dimensioned for at least the friction arising in the control device and the joints of the articulated rod, etc.

Likewise found in the directional valve are centering springs intended for overcoming flow forces and friction. These are normally dimensioned for standard performance requirements, and not for extra friction forces occurring in the control device and joints of the articulated rod, etc.

This means that a maneuvering of the directional valve with aid of hand levers—either with a hand lever directly connected to the directional valve or with a hand lever located some distance away and connected to the articulated rod—is going to require very great maneuvering force because of the fact that the spring assembly in both the directional valve and the control device must be compressed. If the EHC control device is activated, then the force does not play any role. It would however be desirable that these forces do not play any role when maneuvering is performed by means of hand levers, viz. that the hand lever force with connected, but non-activated EHC control devices, are the same as with a normal directional valve provided with only one or more hand levers.

SUMMARY OF THE INVENTION

The present invention accordingly aims at developing a control device of the type mentioned in the introduction. By connecting this control device to a hydraulic directional valve or similar apparatus, the hand lever force will be essentially the same as those of normal directional valves designed exclusively for manual maneuvering with a hand lever. This is achieved in that the piston rod is slidably supported in the piston, whereby a limited movement relative to the piston, is permitted independent of pressure and load conditions in the cylinder, this movement possibility being limited in at least one direction by a first stop arranged on the piston rod.

BRIEF DESCRIPTION OF THE INVENTION

DETAILED DESCRIPTION OF A PREFERRED DESIGN OF THE INVENTION

Figure 1:
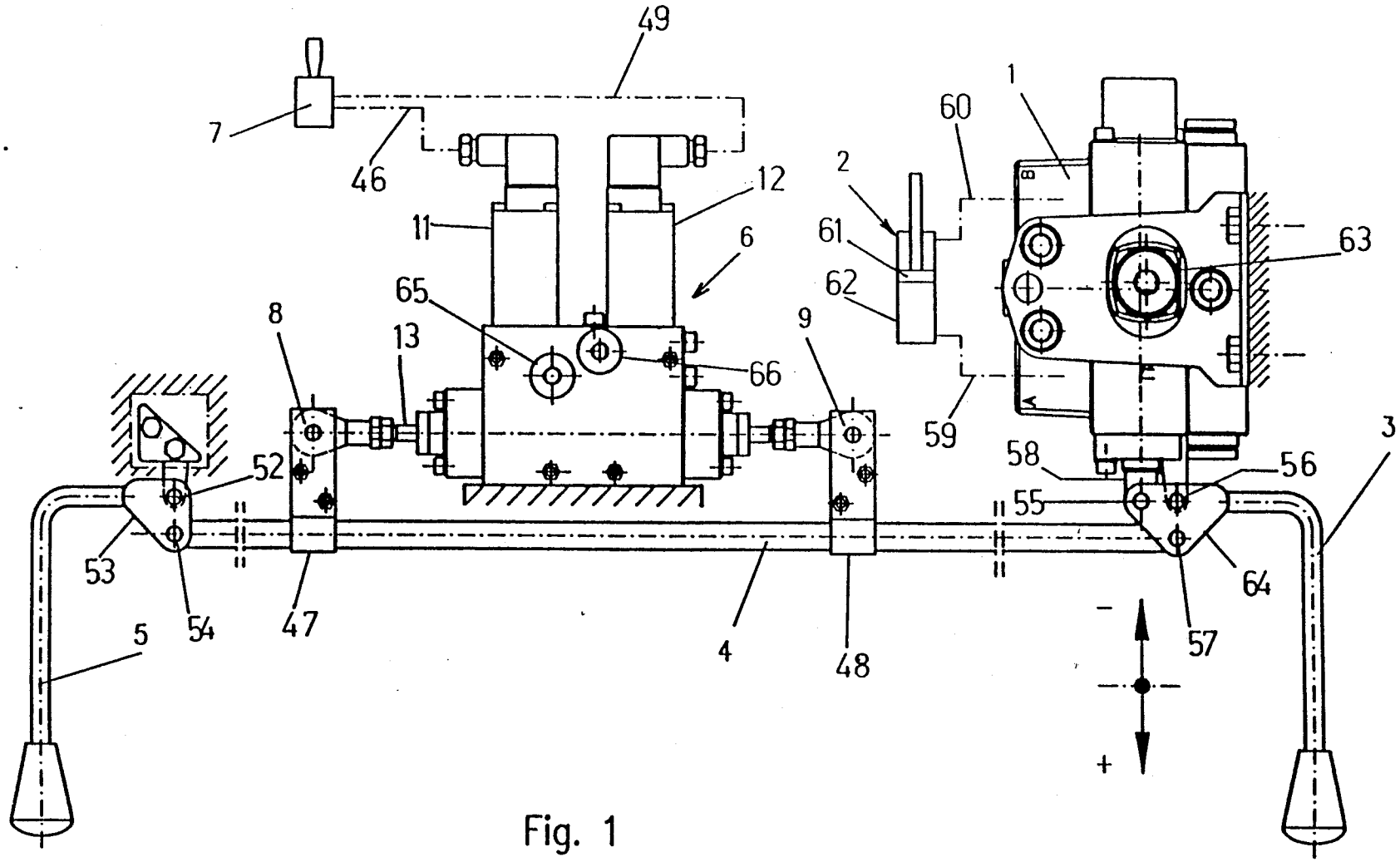
FIG. 1 shows a somewhat schematic picture of a hydraulic control system of the type in question.

The system shown in Figure consists of a directional valve (1) of usual type which includes two motor ports (A and B), which are connected by conduits (59,60) to a hydraulic motor (2), which in this case is comprised of a hydraulic cylinder (62) with piston (61). In addition, a port (63) is included for feeding and evacuating hydraulic fluid. The pump and tank normally found in such a system included are not shown. The directional valve (1) is permanently installed, for example on the frame of a truck.

Also included in the directional valve is a spool (58), to which a hand lever (3) is articulatedly connected by means of a joint (53). The hand lever (3) is further articulatedly connected to the directional valve (1) by means of a joint (56). These joints (55,56) are arranged in a triangular plate (64), to which an articulated rod is connected by a third joint (57), placed at a distance from the joints 55, 56. The articulated rod (4) goes across over the frame of the truck to the other side of the truck, where it in turn is articulatedly connected to a triangular plate (53), which makes up part of a second hand lever (5), the plate 53 being articulatedly connected to a fixed point on the frame by means of a joint (52) placed at a distance from the joint 54. This configuration provides the option for manual maneuvering of the hydraulic motor (2) from either side of the truck. Also connected to the articulated rod 4 is a piston rod (13) of a double-action control device 6 connected by articulated rod ears 8, 9, and clamps 47, 48. If the control device 6 were to be coupled separately from the articulated rod (4), the lever forces found with manual maneuvering of the directional valve (1) by the hand lever 3 or 5 would be the same as those found with a directional valve designed exclusively for maneuvering by means of a hand lever, and which was constructed and installed in the usual manner. The control device 6 includes two electro-hydraulic proportional valves (11, 12), which are connected to a housing (10). The electro-hydraulic proportional valves 11 and 12 are controlled from an electrical control lever (7) via electrical wires 46 and 49. These proportional valves 11 and 12 may, for example, include a three-way slide, and be fitted with a pump connection or a tank connection, as well as a pressure control connection, whereby the position of the slide is balanced mainly by the control pressure coming from the proportional valve and by regulated current generated by magnetic force via the electrical control lever (7). As discussed earlier by way of introduction, it can be seen that with use of a control device of usual design (6) having a double-action piston, the centering springs, which are located in the housing (10), will take part in the movement of the articulated rod in manual maneuvering by means of the hand levers (3,5), if the control device is in a non-active condition, causing disturbingly high lever forces.

Figure 2:
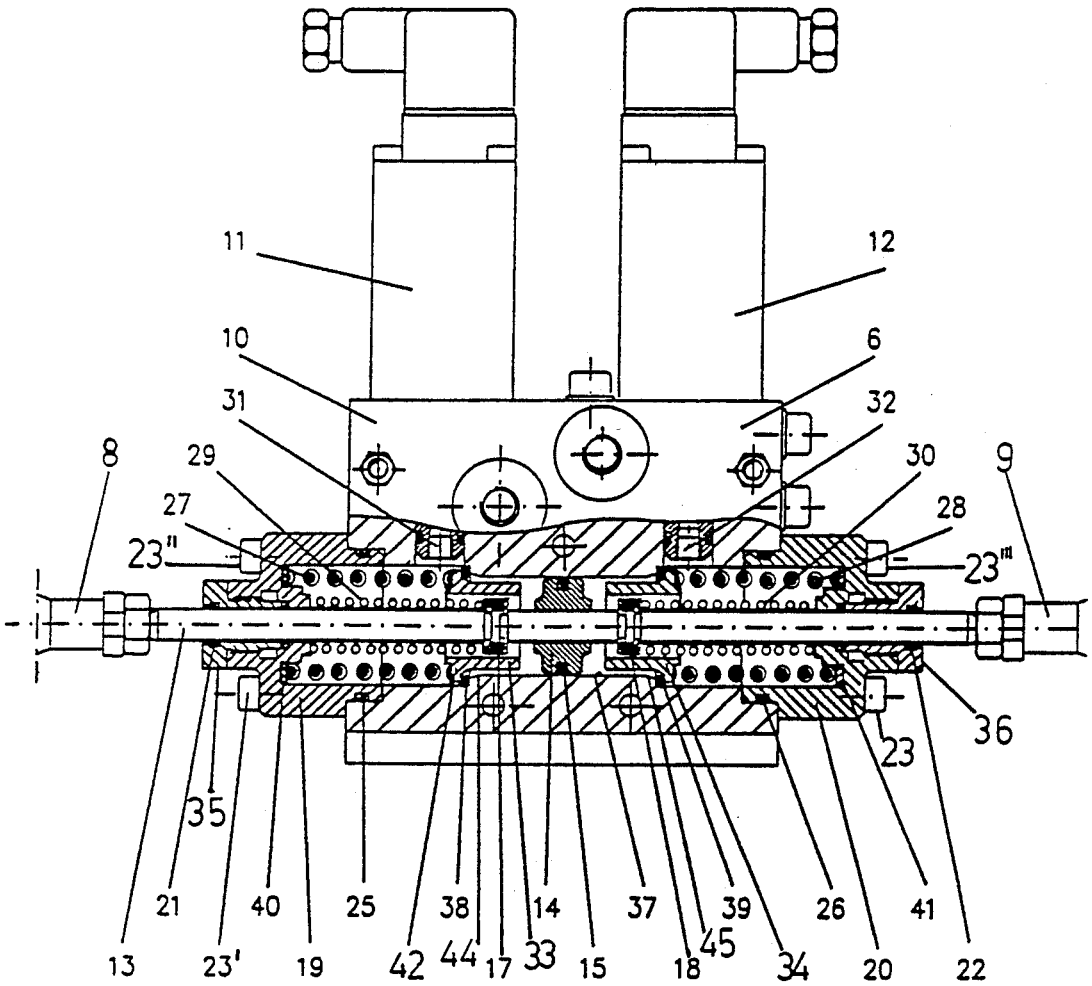
FIG. 2 shows the electro-hydraulic control device in a more detailed form and partly in cross-section.

FIG. 2 shows a closer view of how a control device can be designed to avoid these unwanted high hand lever forces. Here the control device (6) is shown in greater detail. The control device consists mainly of the housing (10) and of the two electro-hydraulic proportional valves (11, 12). A cylinder (37) is arranged in the housing (10), with both ends of the cylinder somewhat flared, forming peripheral steps 44 and 45. The piston (14) is arranged in the central, narrower section of the cylinder (37), and is sealed against the cylinder by means of a seal (15). Both ends of the cylinder (37) are each sealed with caps (19, 20), which are fastened to the housing (10) by means of bolts 23, 23', 23'', 23''' via bushings (35, 36), each with a respective seal (21, 22). Caps 19, 20 are also sealed relative to the housing via seals 25, 26. A piston rod (13) goes through each of the caps and then through a bore in the piston (14), so that the piston rod (13) is limited in one direction of its movement in relation to the piston (14) by a first stop (17), and in the other direction by a second stop (18), in the form of stop rings fixed in the piston rod by use of lock rings. A relatively weak first spring (29) is placed between set collar 17 and cap 19, and a relatively weak second spring (30) is placed between stop ring 18 and cap 20. These relatively weak springs 29, 30 serve for centering the piston rod in the cylinder (37). The ends of the piston rod (13), which project out from the control device, are each terminated by an articulated-rod ear (8,9). Flanges (42,43) on two sleeves (33,34) which project into the cylinder (37) from each direction rest against each of the steps (44,45), respectively. Each of the sleeves (33,34) thus surrounds a respective stop ring (17,18). Each of the sleeves (33,34) is biased against respective steps (44,45) by means of each one of the two relatively strong springs 27, 28; the other ends of these springs resting against their respective caps (19,20). The tension of springs 27,28 can be varied by use of spacing washers (40,41). In describing the springs 29, 30 and 27, 28 as relatively weak and relatively strong, it will be appreciated that the springs 29, 30 are relatively weak as compared to springs 27, 28 and the latter are relatively strong as compared to springs 29, 30. Load-distributing insert collars (38,39) are placed between respective flanges (42,43) and steps (44,45). The flared sections on the cylinder (37), together with their respective caps (19,20), form two chambers, one on each side of the piston (14), into which hydraulic fluid can be fed and evacuated by means of the electro-hydraulic proportional valves (11,12) through the ports (31,32). The connections (65,66) for a pump and tank, respectively, can also be seen on the exterior of the housing (10).

The control device (6) functions in the following manner. If the directional valve is to be operated by remote control by means of the electrical control lever (7) and the piston rod is to be moved to the right, for example, as in FIGS. 1 and 2, then hydraulic fluid is fed through port 31 from proportional valve 11, which means that the piston (14) is shifted on the piston rod (13) without the latter being moved to the right, until the piston (14) comes into contact with the stop ring (18) and the sleeve (34). After this, and with continued feeding of hydraulic fluid via port 31, the piston (14) will force the piston rod (13) to the right in the figure, against the effect of the force transferred from spring 28 via sleeve 34. At this stage, hydraulic fluid can obviously pass freely through port 32. As seen in FIG. 1, movement of the piston rod can accordingly be transferred to the articulated rod (4) via clamps 47, 48, which in turn causes the plate (64) to rotate in a counter-clockwise direction, with a resulting spool movement in plus direction in accordance with the figure. In a corresponding manner, an activating of the electro-hydraulic valve (12) will lead to a piston rod movement to the left in the figure with a resulting spool movement in minus direction in accordance with the figure. Both of these two methods of operating are pure EHC controlling. With pure hand controlling, viz. when both the electro-hydraulic valves 11 and 12, respectively, are in their non-activated state, then one of hand levers 3 or 5 is rotated around joint 52, 56, respectively. As a result of this, the articulated rod (4) will be shifted to the right or to the left in the figure, to the right causing a spool movement in plus direction, while a movement to the left in the figure causes a spool movement in minus direction. Since the piston rod (13) is attached to the articulated rod (4) by means of clamps 47 and 48, the former will likewise be caused to shift to the right or left, respectively. Since the piston rod can move freely relative to the piston (14) and to both the sleeves (33,34) against the effect from one of the relatively weak springs (23,30) the hand levers (3,4) can be swung for maneuvering the directional valve (1) without being influenced by forces from the relatively strong springs (27,28) which means that the lever force will in principle be of the same order of dimension as when using a directional valve designed exclusively for maneuvering with hand levers to which no control device is connected. The position where the piston winds up at, between the sleeves (33,34), has no significance here, since the hydraulic fluid can flow freely through both the ports (31,32) when the electro-hydraulic valves are non-activated.

In this manner, four basic modes of function thus can be achieved, namely:

A. − slide movement using pure manual controlling,
B. + slide movement using pure manual controlling,
C. − slide movement using pure EHC controlling,
D. + slide movement using pure EHC controlling.

As has been seen, therefore, one can have an option of manually maneuvering the directional valve without experiencing excessive lever forces by using the hand levers (3,5), despite a control device with strong centering springs having been connected to the articulated rod (4). The preferred form of executing the invention as described here is especially well suited for subsequent complementing of already existing hand lever systems having transverse articulated rods, but can of course likewise be utilized when manufacturing new directional valves and/or new installation of directional valves on, for example, trucks.

POSSIBLE MODIFICATIONS OF THE INVENTION

Figure 3:
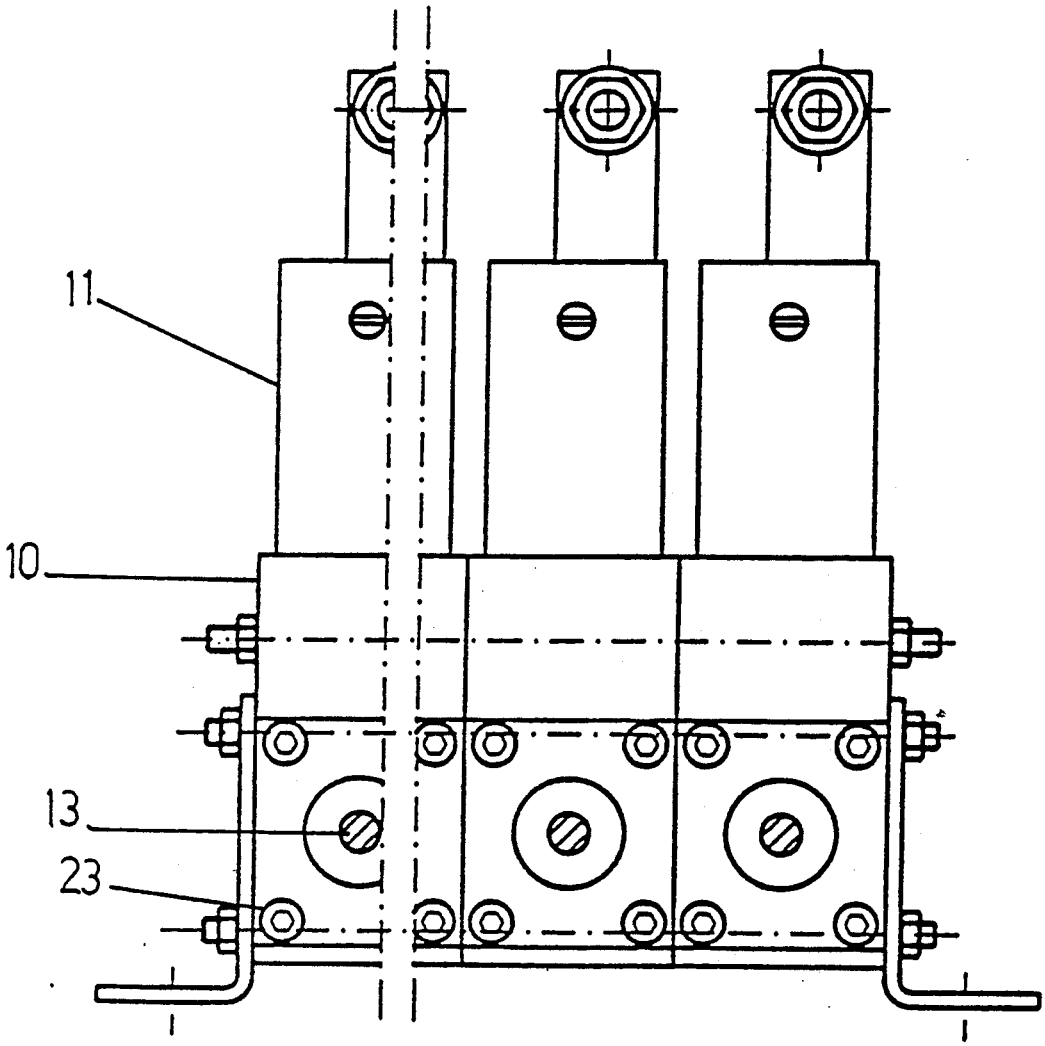
FIG. 3 shows in side view how the electro-hydraulic control device can be combined with additional control devices for controlling of several directional valves.

This invention can of course be modified in a multitude of ways within the scope of the attached claims. For example, it is possible to replace the electro-hydraulic valves (12,13) with a valve delivering a control pressure placed at a suitable position, the control pressure being regulated with a usual control lever. In the preferred execution of this invention, the arrangement has been described as being symmetrically constructed and double acting. However, it is entirely possible to execute the arrangement asymmetrically with a piston and only one centering spring, one sleeve and one stop, and a single electro-hydraulic proportional valve, or in some other corresponding fashion. This for example, is possible when a dumping movement of a bed of a truck is performed by means of a single-acting hydraulic cylinder, especially if the movement of that hydraulic cylinder is controlled by a typical directional valve. In a manner similar to that described above, one can arrange two hand levers interconnected by means of an articulated rod, which directly acts on the spool in the directional valve, while an asymmetrical control device is coupled to the articulated rod in a manner similar to that described above. It then becomes possible to control the dumping movement from either side of truck, or also, for example, from the cab. The control device can be maneuvered electro-hydraulically as described above, or preferably hydraulically. The bed then returns to its original position because of its dead weight upon de-activating of the control device. The control device can of course be connected in a multitude of ways to a manual control system. It is not necessary to use two clamps as in the manner illustrated, nor is it necessary to connect the control device to an articulated rod. The piston rod (13) can of course be connected directly to a hand lever. It is even conceivable to connect the piston rod (13) to a Bowden wire or similar mechanical transfer mechanisms in cases where these are used. FIG. 3 illustrates a further alternative where a number of control devices 6, 6', 6'' are connected in side-by-side relationship for controlling several directional valves.

We claim:

1. A device for alternative controlling of a hydraulic directional valve including both a manually operable actuating mechanism mechanically coupled to said directional valve and a pilot pressure controlled hydraulic actuator including a cylinder, a piston and a piston rod, said piston rod positively coupled to said actuating mechanism so as to accomplish shifting of said directional valve, wherein said piston is freely movable relative to said piston rod between two axially spaced abutment means on said piston rod and wherein two piston abutting sleeves are movably supported in said cylinder, said sleeves being spring biased towards oppositely facing shoulders in said cylinder such that when said sleeves are in contact with respective ones of said shoulders, said sleeves permit axial movement of said piston a distance that is substantially equal to axial movement of said piston permitted between said abutment means on said piston rod.

2. A device according to claim 1, whereby said piston rod is biased towards an initial position under the influence of at least one relatively weak spring as compared to said spring biasing said sleeve, which is supported by said abutment means.

3. A device according to claim 1 in which feeding and exhausting, respectively, of hydraulic fluid to/from said cylinder is regulated by means of at least one electro-hydraulic proportional valve, which by means of electrical wires is coupled with an electrical hand lever, by means of which the control device thus can be directed.

* * * * *